US010315123B2

(12) United States Patent
Cherednichenko et al.

(10) Patent No.: US 10,315,123 B2
(45) **Date of Patent: *Jun. 11, 2019**

(54) CONVERTIBLE TOY VEHICLE PLAYSET

(71) Applicant: Mattel, Inc., El Segundo, CA (US)

(72) Inventors: Andrey Cherednichenko, Los Angeles, CA (US); Berrigan A. R. Lennon, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/619,230

(22) Filed: Jun. 9, 2017

(65) Prior Publication Data

US 2017/0274291 A1 Sep. 28, 2017

Related U.S. Application Data

(63) Continuation of application No. 14/576,356, filed on Dec. 19, 2014, now Pat. No. 9,707,490.

(51) Int. Cl.
*A63H 18/02* (2006.01)

(52) U.S. Cl.
CPC ..... *A63H 18/02* (2013.01)

(58) Field of Classification Search
CPC ..... A63H 18/02; A63H 18/021; A63H 18/04; A63H 18/06
See application file for complete search history.

(56) References Cited

U.S. PATENT DOCUMENTS 2,992,598 A 7/1961 Einfalt
3,209,491 A 10/1965 Roeper
3,775,897 A 12/1973 Soulakis et al.
3,908,989 A 9/1975 Meyer
4,051,624 A 10/1977 Ogawa
4,227,693 A 10/1980 Moe et al.
4,249,733 A 2/1981 Eddins et al.
4,558,867 A 12/1985 Hippely
4,564,197 A 1/1986 Lambert
4,585,166 A 4/1986 Stephens
4,661,080 A 4/1987 Goldstein et al.
4,867,723 A 9/1989 Asbach
5,174,569 A 12/1992 Ngai
5,643,040 A 7/1997 Hippely et al.
5,683,298 A 11/1997 Jackson
5,767,655 A 6/1998 Ostendorff et al.
6,402,583 B2 6/2002 Yoneda et al.
6,510,956 B2 1/2003 Therber
6,951,497 B1 10/2005 Ngan
7,614,931 B2 11/2009 Nuttall
7,704,118 B2 4/2010 Divnick
7,892,068 B2 2/2011 Nuttall et al.
8,066,545 B2 11/2011 Jourdian et al.
8,162,716 B2 4/2012 Nuttall
8,176,852 B2 5/2012 O'Connor
8,298,038 B2 10/2012 O'Connor et al.
(Continued)

*Primary Examiner* — Jason C Smith

(74) *Attorney, Agent, or Firm* — Sheppard Mullin Richter & Hampton LLP

(57) ABSTRACT

Disclosed is a convertible toy vehicle playset convertible from a first configuration to a second, altered configuration upon a predetermined interaction with a toy vehicle. A convertible track segment includes a tower, a base mounted atop the tower, and a platform rotatably mounted atop the base. The base includes a retractable support, and the platform includes a trigger operable to retract the retractable support into the base.

21 Claims, 15 Drawing Sheets

(56) References Cited

U.S. PATENT DOCUMENTS

| | | | |
|---|---|---|---|
| 8,449,344 | B2 | 5/2013 | Nuttall et al. |
| 8,567,690 | B2 | 10/2013 | De La Torre |
| 8,734,200 | B2 | 5/2014 | Payne et al. |
| 2005/0191938 | A1 | 9/2005 | Sheltman et al. |
| 2005/0191940 | A1 | 9/2005 | Sheltman et al. |
| 2007/0049160 | A1 | 3/2007 | Matthes et al. |
| 2010/0112896 | A1 | 5/2010 | Chang |
| 2011/0269371 | A1 | 11/2011 | Nuttall |
| 2011/0294396 | A1 | 12/2011 | O'Connor et al. |
| 2012/0264350 | A1 | 10/2012 | Ostendorff et al. |
| 2012/0309263 | A1 | 12/2012 | Lennon et al. |
| 2013/0309937 | A1 | 11/2013 | Ostendorff |
| 2014/0256220 | A1 | 9/2014 | Lennon |
| 2016/0175727 | A1 | 6/2016 | Cherednichenko |

CONVERTIBLE TOY VEHICLE PLAYSET

CROSS-REFERENCE TO RELATED APPLICATION

The present application claims priority to U.S. patent application Ser. No. 14/576,356, entitled "Convertible Toy Vehicle Playset," filed Dec. 19, 2014, the entire contents of which are incorporated into this application by reference.

FIELD OF THE INVENTION

This invention relates to convertible toy vehicle playsets, and more particularly to a convertible toy vehicle track set segment convertible from a first configuration to a second, altered configuration upon a predefined interaction with a toy vehicle.

BACKGROUND

Toy vehicle playsets and track sets are popular among children of varied ages, and a variety of track configurations have previously been provided that include various features to add to the excitement a child experiences while playing with the toy. For instance, toy vehicle playsets and track sets have been provided having portions of the track that are moveable and that may change position with respect to other portions of the track during play. For example, U.S. Pat. No. 4,585,166 to Stephens discloses a collapsible toy automobile race course that acts as a spring and may assume a relaxed collapsed position in one condition, and an extended taut position in another condition. Likewise, U.S. Pat. No. 4,867,723 to Asbach discloses a toy simulated exploding shack that is actuated by a toy car running through the doors of the shack, which in turn causes various panels of the shack to move, ultimately simulating an explosion of the shack. Further, U.S. Pat. No. 6,402,583 discloses a toy vehicle parking facility having a rotatable and vertically moveable turntable that carries a toy vehicle to a designated floor to either move the toy vehicle to a parking spot or away from the parking spot and down a ramp to exit the toy parking facility. Still further, U.S. Pat. No. 8,162,716 to Nuttall discloses a toy vehicle track set having a moveable, spiral track portion that may be raised and lowered to different elevations during play.

While the foregoing configurations do provide changeable configurations of various toy vehicle track set elements during play, there remains an ongoing need to provide toy vehicle track set features capable of maintaining the interest of a child and increasing the excitement and amusement they experience when playing with a toy racetrack. It would therefore be advantageous to provide a toy vehicle track set with varying play patterns that modify the track set configuration so as to further enhance the excitement and amusement offered to a child as they engage in such play.

SUMMARY OF THE INVENTION

Disclosed is a convertible toy vehicle playset convertible from a first configuration to a second, altered configuration upon a predefined interaction with a toy vehicle. A convertible track segment includes a rotating platform mounted above a base and a trigger located on the rotating platform that may be engaged by a toy vehicle. The trigger is configured to cause the convertible track segment to undergo a transformation only when the rotating platform is within a specific, predetermined rotational angle range with respect to the base.

More particularly, and with regard to an exemplary embodiment of the invention, the base has a plurality of retractable supports that are operatively attached to the trigger, which retractable supports releasably hold a portion of a toy vehicle track set in an elevated position. An outer track portion is also provided that extends partially around the platform and that, in one configuration, aligns with the portion of the track set in the elevated position. When the rotating platform is within the specific, predetermined rotational angle range, and a toy vehicle engages the trigger on the rotating platform, the convertible track segment undergoes a transformation in which the outer track portion pivots downward with respect to the base and the portion of the toy vehicle track set drops downward with respect to the base, such that the base and the rotating platform transform into the shape of an alternative structure, such as a toy vehicle play stand, and more particularly a display trophy with the toy vehicle resting atop the trophy.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
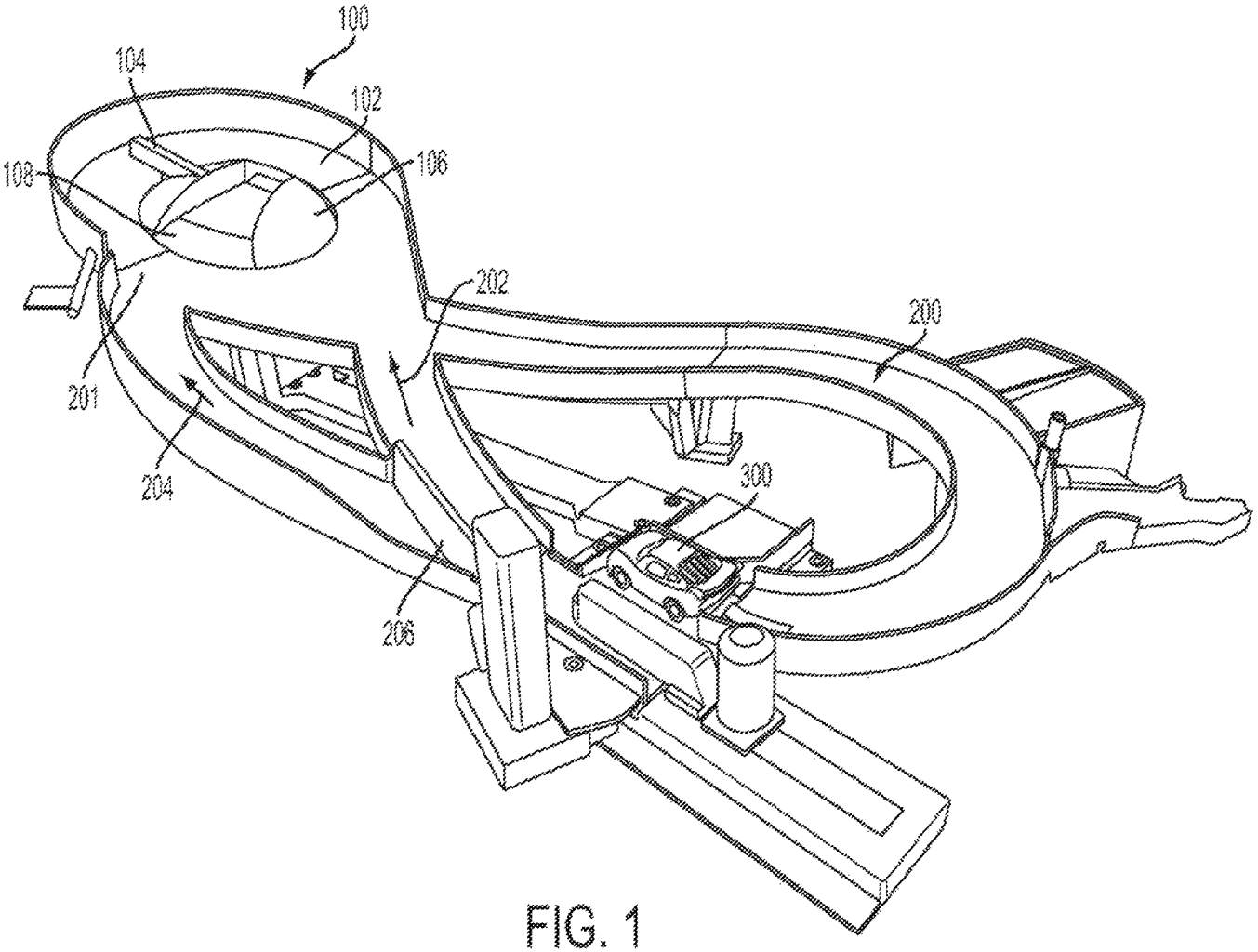
FIG. 1 is a perspective view of a convertible toy vehicle playset in a first configuration in accordance with certain aspects of an embodiment of the invention.
Figure 2:
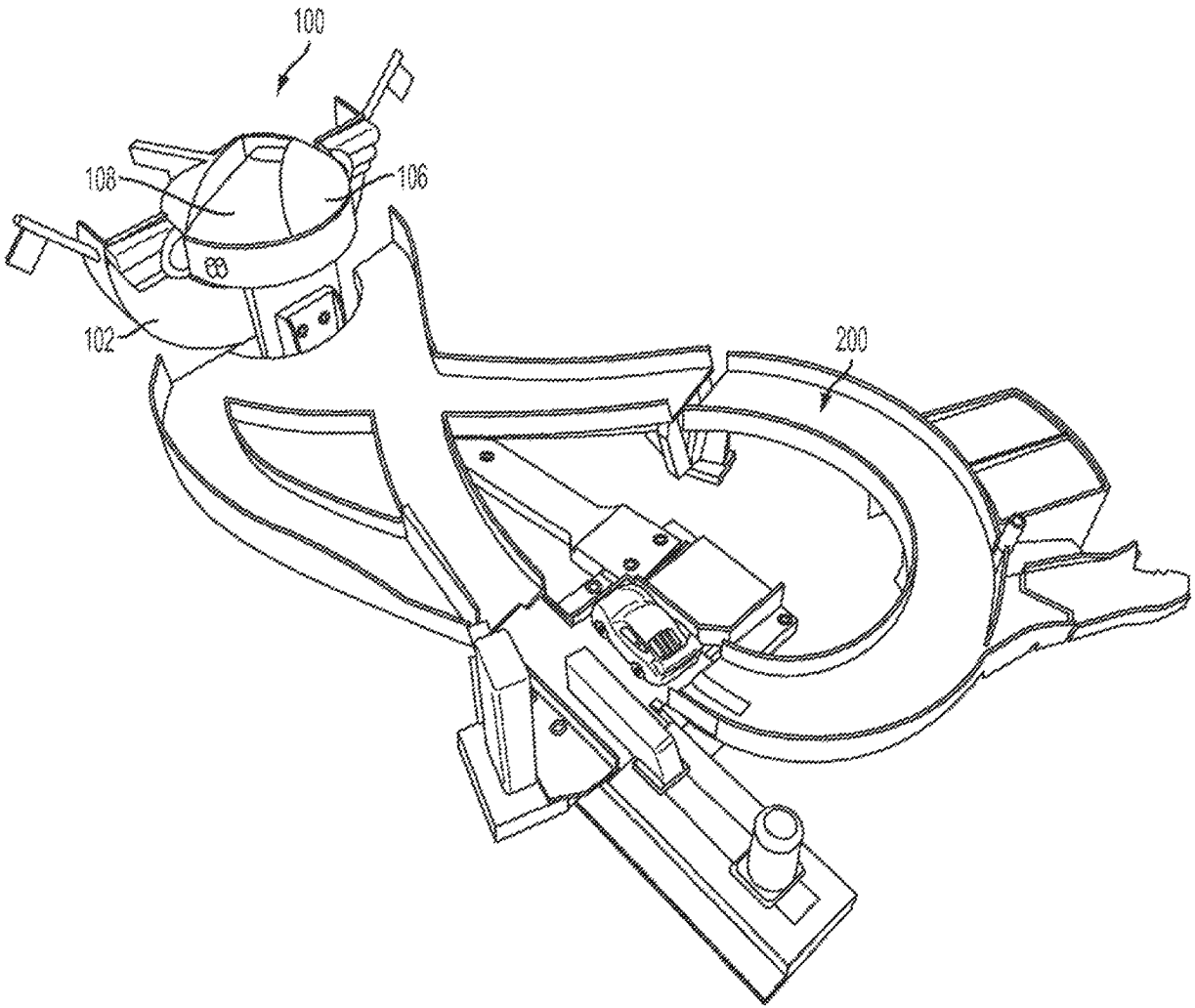
FIG. 2 is a perspective view of the convertible toy vehicle playset of FIG. 1 in a second, transformed configuration.

In an exemplary embodiment of the invention, and with particular reference to FIG. 1, a convertible track segment (shown generally at 100) is provided and is attached to a toy vehicle track set (shown generally at 200). A toy vehicle 300 traverses toy vehicle track set 200 through a path that directs it toward convertible track segment 100. In an embodiment of the invention, toy vehicle 300 may travel through a first path 202 toward convertible track segment 100, which directs toy vehicle 300 around an outer track portion 102 of convertible track segment 100 and back to toy vehicle track set 200. As toy vehicle 300 travels around outer track portion 102 of convertible track segment 100, it strikes arm 104 of rotating platform 106, in turn causing rotating platform 106 to spin. Likewise, toy vehicle 300 may traverse toy vehicle track set 200 through a second path 204 toward convertible track segment 100, which directs toy vehicle 300 directly toward rotating platform 106. If rotating platform 106 has been spun into a predetermined angular orientation, toy vehicle 300 travels from second path 204 into a recess 108 on rotating platform 106, where toy vehicle 300 comes to a stop. As toy vehicle 300 enters recess 108, toy vehicle 300 engages a trigger that activates a transformation of convertible track segment 100, as long as toy vehicle 300 is in the predetermined angular orientation. More particularly and with reference to FIG. 2, toy racetrack 200 detaches from convertible track segment 100 and outer track portion 102 pivots downward, transforming convertible track segment 100 into the shape of a display trophy as shown in FIG. 2.

A diverter 206 may optionally be provided, and manually adjusted by a user to select the path through which they wish for toy vehicle 300 to travel. Thus, when rotating platform 106 has achieved the predetermined angular orientation, the user may adjust diverter 206 to direct toy vehicle 300 through second path 204 and into recess 108 on rotating platform 106, and initiate the transformation of convertible track segment 100 into the display trophy of FIG. 2.

Figure 3A:
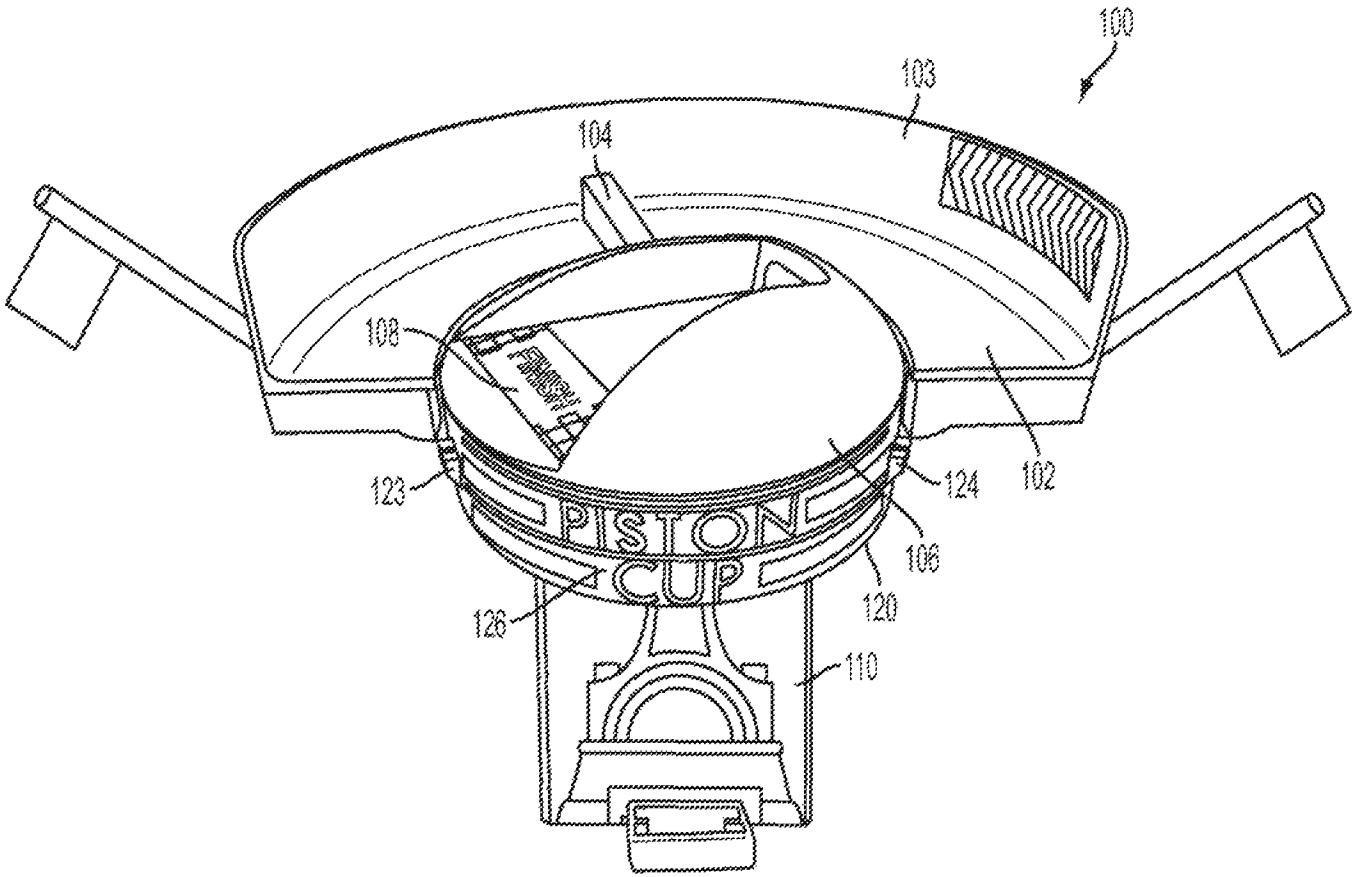
FIG. 3*a* is a front view of a convertible track segment in accordance with certain aspects of an embodiment of the invention.
Figure 3B:
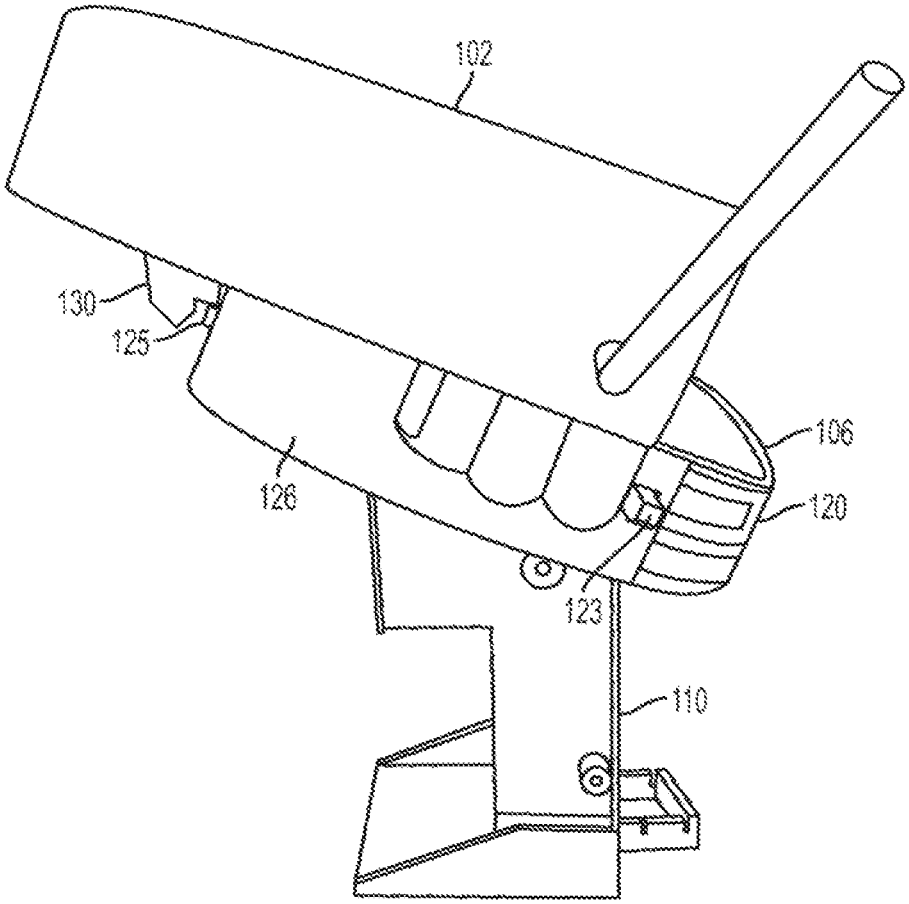
FIG. 3*b* is a side view of the convertible track segment of FIG. 3*a*.
Figure 4:
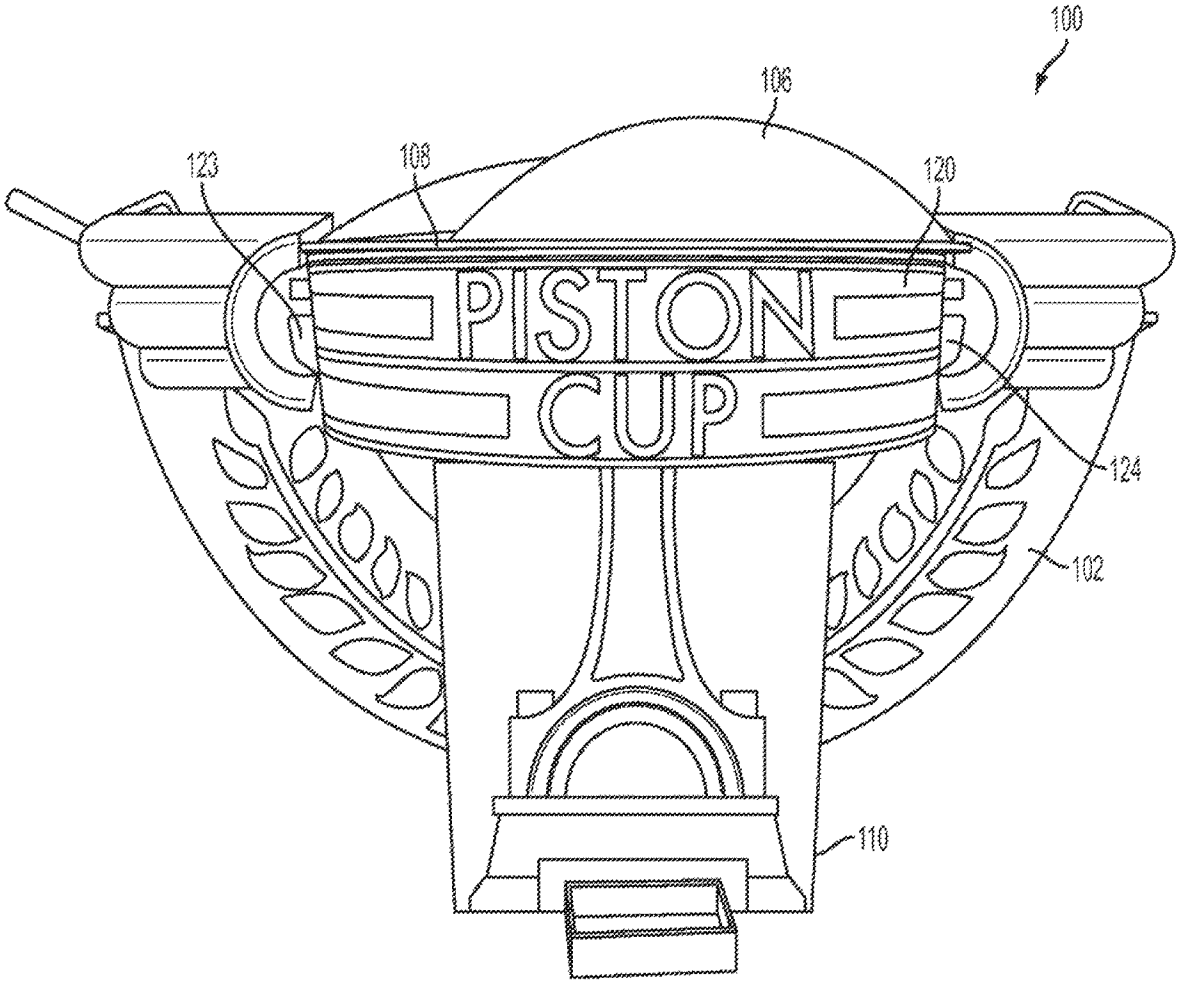
FIG. 4 is a front view of the convertible track segment of FIG. 3*a* in a second, transformed configuration.

FIG. 3*a* provides a front view, and FIG. 3*b* a side view, of convertible track segment 100, showing convertible track segment 100 in its initial position in which it may be joined to toy vehicle track set 200. In this position, outer track portion 102 is situated at a slightly upward angle. Rotating platform 106 is freely, rotatably affixed to base 120, which base 120 is likewise pivotably mounted to tower 110 and releasably held in the upward angle shown in FIGS. 3*a* and 3*b*. Outer track portion 102 is likewise pivotably mounted to base 120, and is releasably held in the upward angle shown in FIGS. 3*a* and 3*b* so that outer track portion 102 is generally in the same plane as recess 108. As shown in the front view of convertible track segment 100 of FIG. 4, after a toy vehicle 300 has engaged the trigger in recess 108 (and as will be discussed in greater detail below), convertible track segment 100 converts to the shape of a display trophy, with base 120 pivoting with respect to tower 110 so as to horizontally orient recess 108, and with outer track portion 102 pivoting downward with respect to base 120 so as to vertically orient outer track portion 102 behind tower 110.

Figure 5:
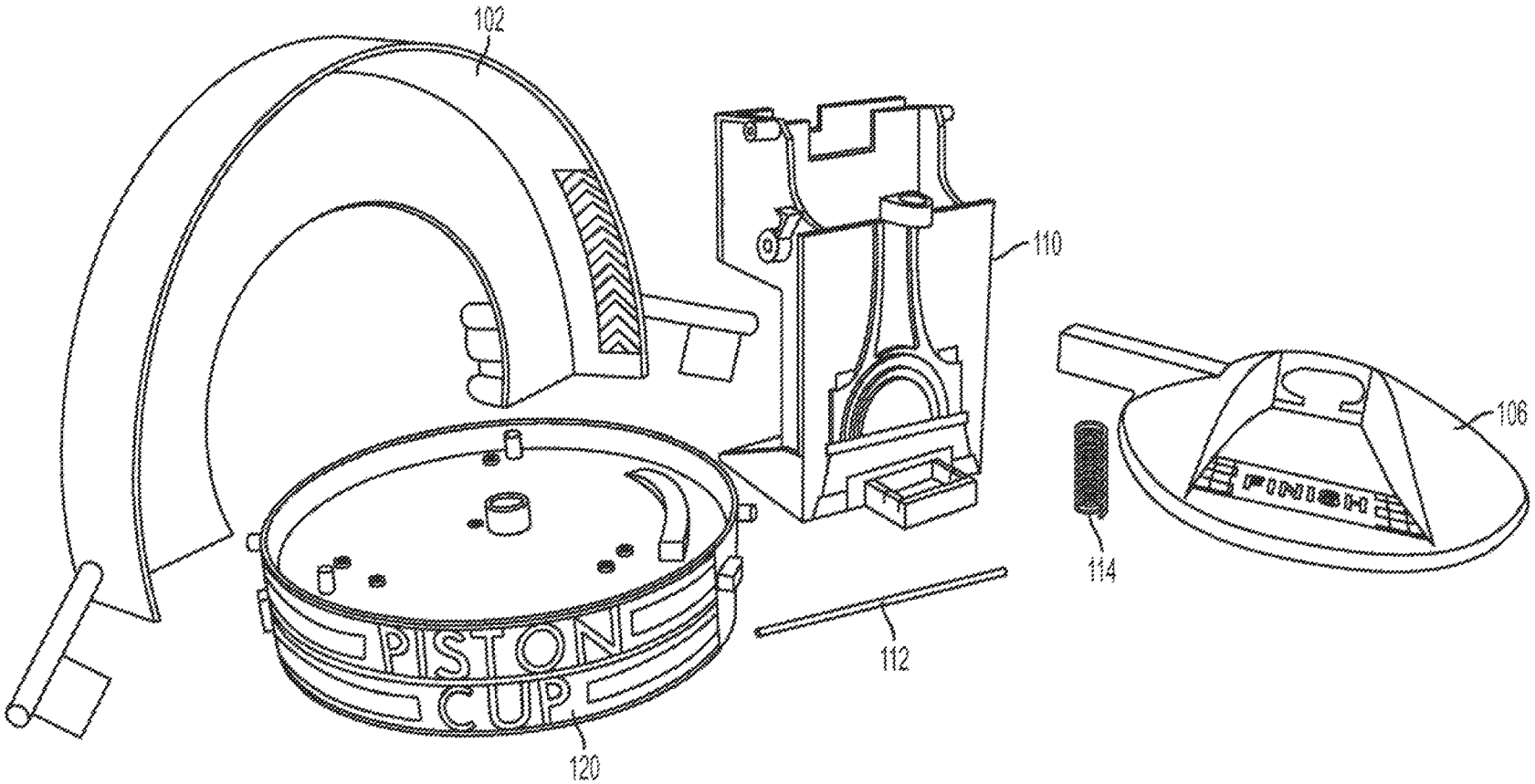
FIG. 5 is an exploded view of the convertible track segment of FIG. 3*a*.

FIG. 5 provides an exploded view of convertible track segment 100, including tower 110, base 120, rotating platform 106, outer track portion 102, pivot pin 112, and coil spring 114, each of which will now be discussed in greater detail.

Figure 6A:
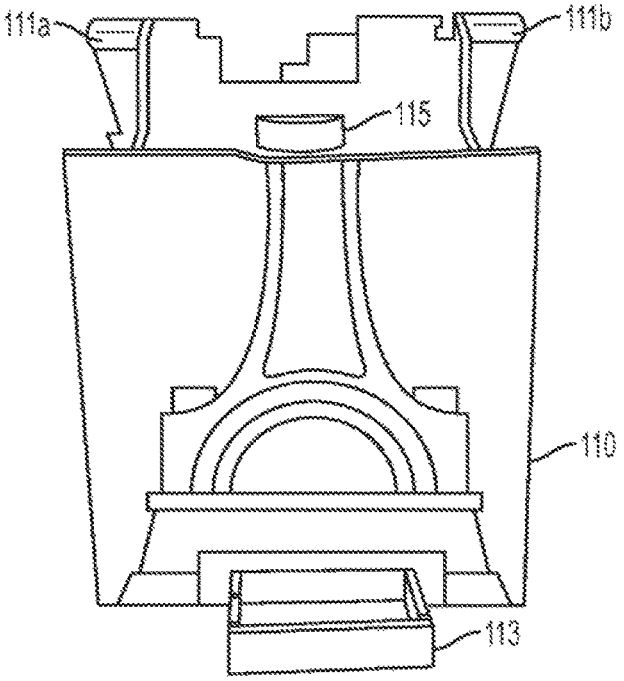
FIG. 6*a* is a front view of a tower for use with the convertible track segment of FIG. 3*a*.
Figure 6B:
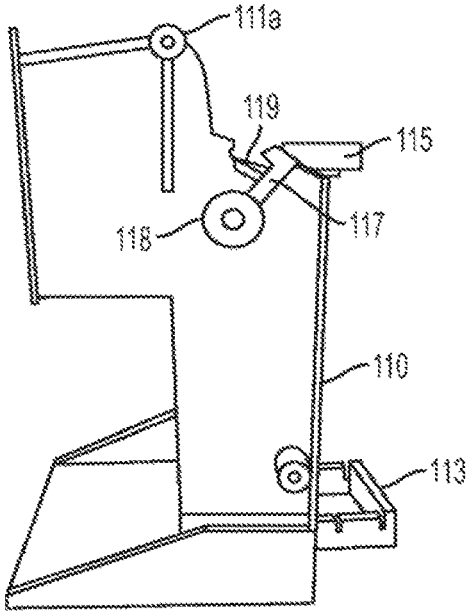
FIG. 6*b* is a side view of the tower of FIG. 6*a*.
Figure 7:
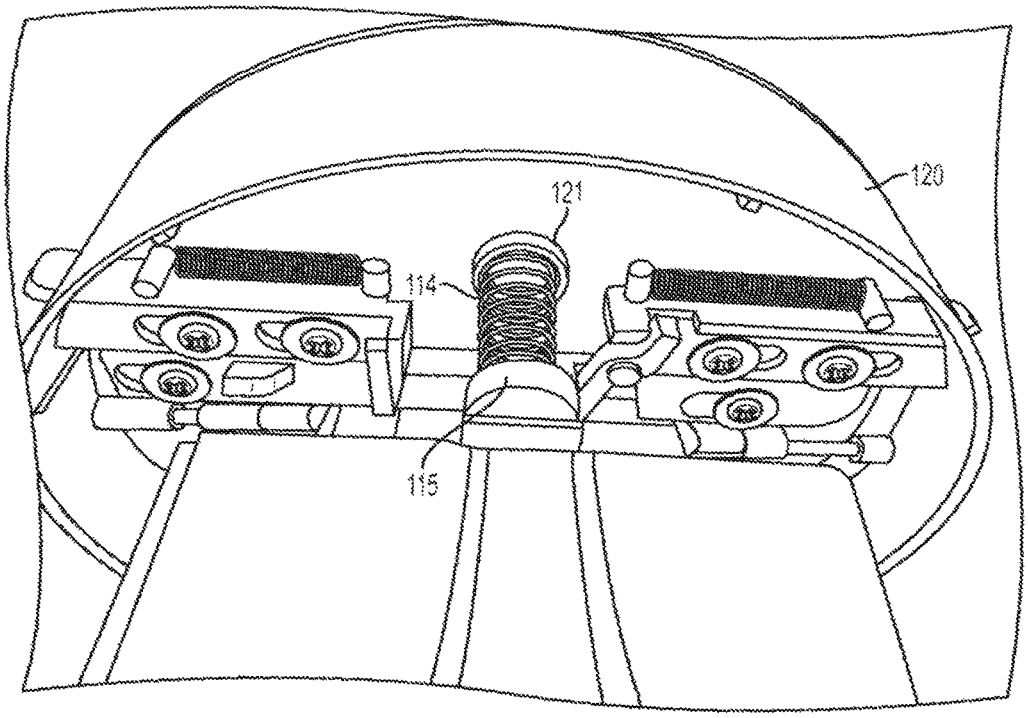
FIG. 7 is a bottom perspective view of a base for use with the convertible track segment of FIG. 3*a*.
Figure 8:
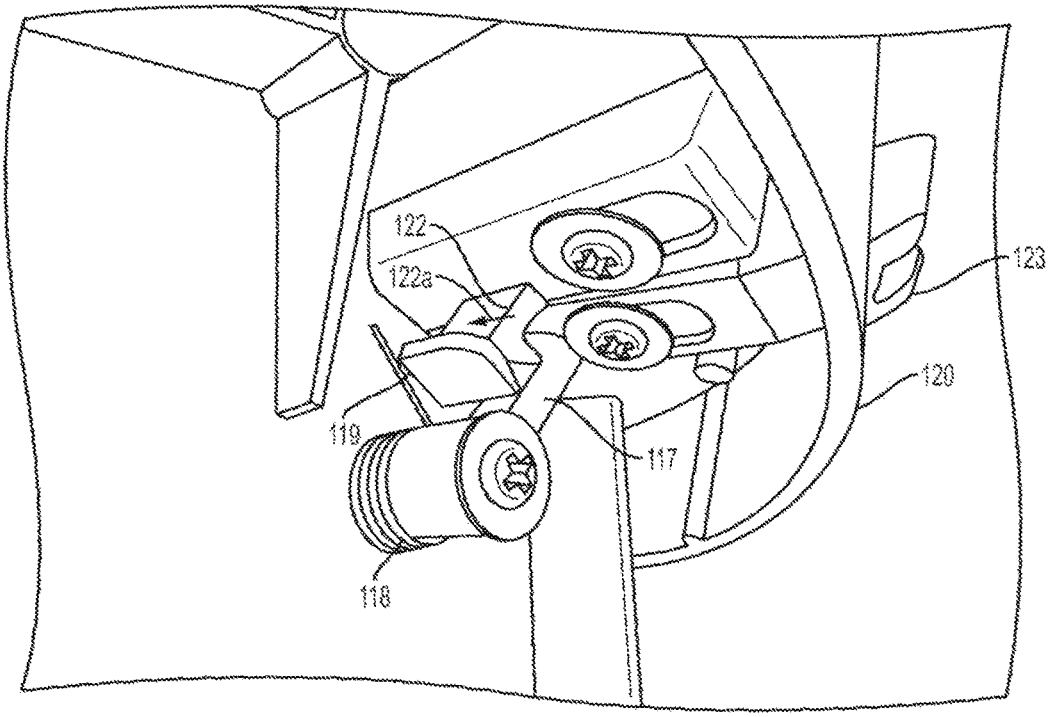
FIG. 8 is a bottom, close-up view of a portion of the base of FIG. 7.

As shown in the front view of FIG. 6*a* and the side view of FIG. 6*b*, base 110 includes base hinge mounts 111*a*, 111*b*, which are aligned with one another and configured to receive a pivot pin 112, which pivot pin 112 also pivotably mounts base 120 and outer track portion 102, as discussed in greater detail below. A connection tab 113 may be provided at the bottom of base 110 and may be used for connection of convertible track segment 100 to racetrack 200. A spring receiver 115 may be provided at an upper edge of base 110, and is configured to receive a first end of coil spring 114. As shown in FIG. 7, a second spring receiver 121 is located on the bottom of base 120, and is configured to receive an upper end of spring 114, such that coil spring 114 exerts an upward spring bias on the bottom of base 120. As shown in the side view of FIG. 6*b* of tower 110, an engagement hook 117 is pivotably mounted to a side of tower 110 and is biased by spring 118 in a counter-clockwise direction (as viewed in FIG. 6*b*) toward a stop surface 119. As shown in the bottom detail view of FIG. 8, engagement hook 117 releasably holds retaining hook 122 on the bottom side of base 120, holding base 120 in the upwardly angled position until the trigger in recess 108 is activated, moving retaining hook 122 away from engagement hook 117 (in the direction of arrow 122a) and allowing base 110 to pivot to the horizontal position. When a user resets base 120 to its upwardly angled position, retaining hook 122 re-engages engagement hook 117 so as to hold base 120 in its upwardly angled position.

Base 120 is also provided a plurality of outwardly spring-biased retractable supports that extend through the sidewall 126 of base 120. Specifically, a first retractable support 123 is positioned on a first side of the sidewall 126 of base 120, forward of outer track portion 102. Likewise, a second retractable support 124 is positioned on a second side of sidewall 126 of base 120, generally opposite from first retractable support 123, and again forward of outer track portion 102. With reference to FIGS. 1 and 2, first retractable support 123 and second retractable support 124 are configured to hold a first end portion 201 of toy vehicle track set 200 that intersects with convertible track segment 100. Thus, when first retractable support 123 and second retractable support 124 are in their extended positions (shown in FIGS. 3*a* and 3*b*), first end portion 201 of toy vehicle track set 200 sits flush and aligned with convertible track segment 100 to allow smooth transition for toy vehicle 300 as it moves from track set 200 to convertible track segment 100, and vice versa. When toy vehicle 300 engages the trigger in recess 108 on rotating platform 106 (when rotating platform 106 is in the predetermined angular orientation), first retractable support 123 and second retractable support 124 are both drawn into base 120, allowing first end portion 201 of toy racetrack 200 to drop down, away from rotating platform 106 and toward the play surface as shown in FIG. 2.

Figure 9:
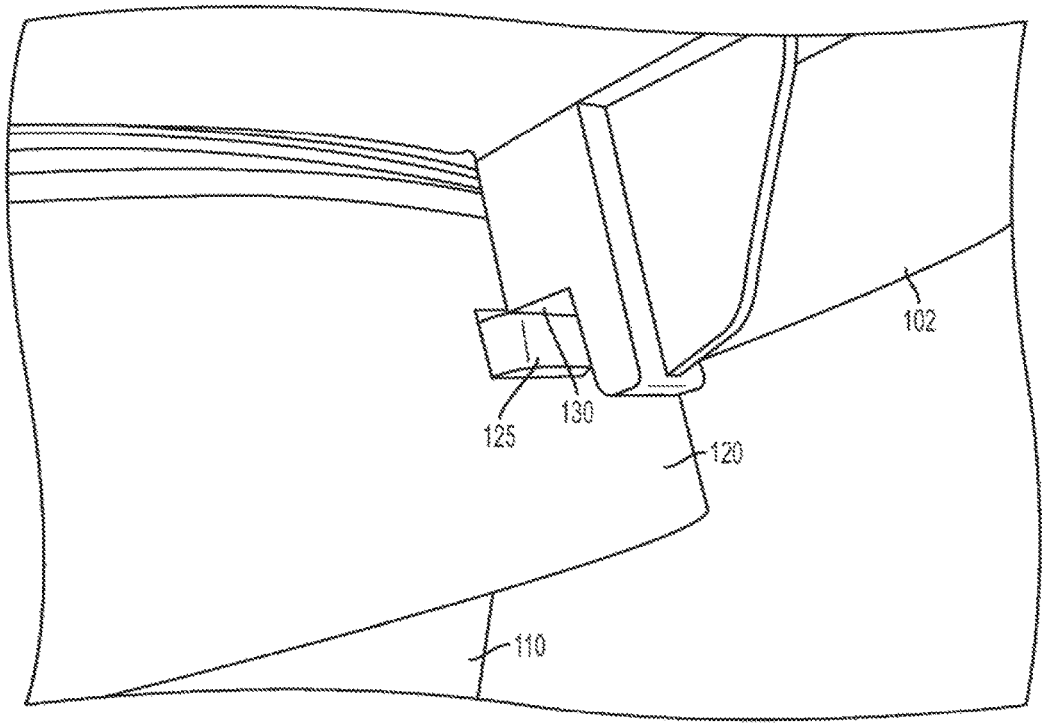
FIG. 9 is a bottom, close-up view of another portion of the base of FIG. 7.
Figure 10:
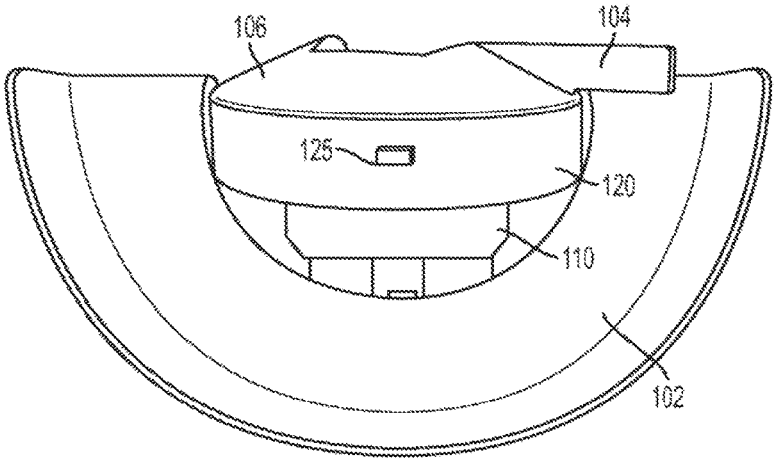
FIG. 10 is a back view of the convertible track segment of FIG. 4.
Figure 11:
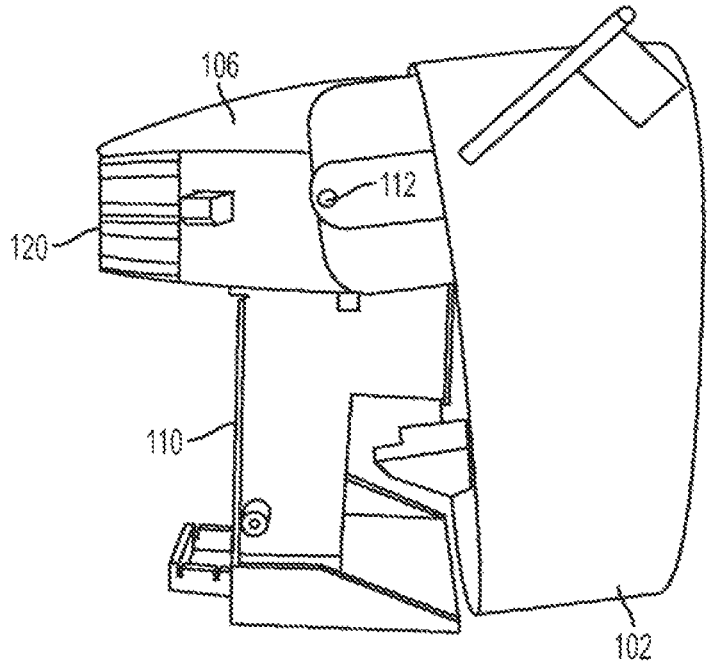
FIG. 11 is a side view of the convertible track segment of FIG. 4.

Similarly, third retractable support 125 (shown in detail in FIG. 9) is positioned on the back side of the sidewall 126 of base 120, and is configured to support the underside of outer track portion 102, and more particularly a flange 130 that extends downward from the underside of outer track portion 102, so as to hold outer track portion 102 in a position in which outer track portion 102 is generally in the same plane as recess 108 of rotating platform 106. When toy vehicle 300 engages the trigger in recess 108 on rotating platform 106 (when rotating platform 106 is in the predetermined angular orientation), third retractable support 125 is drawn into base 120, allowing outer track portion 102 to pivot downward about pivot pin 112 with respect to base 120 and into the vertical orientation behind tower 110 shown in FIG. 4. FIGS. 10 and 11 likewise show rear and side views, respectively, of convertible track segment 100 with outer track portion 102 pivoted to such downward position with respect to base 120.

Each of first, second, and third retractable supports 123, 124, and 125 preferably have an outer wall that forms an angled engagement face extending outward from the bottom to the top of each retractable support, such that as each of the first end portion 201 of toy vehicle track set 200 and outer track portion 102 are raised to the position shown in FIG. 1, each retractable support is gradually pushed inward until the supported portions of the first end portion 201 of track set 200 and outer track portion 102 have cleared their respective retractable support, at which point each retractable support extends outward (as a result of an outward spring bias) to its supporting position.

Figure 12:
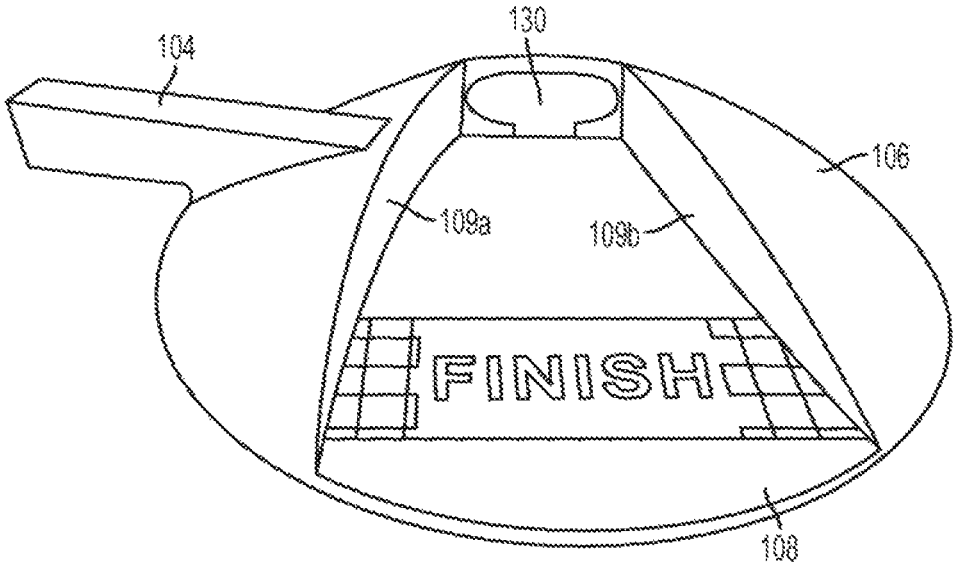
FIG. 12 is a perspective view of a rotating platform for use with the convertible track segment of FIG. 3*a*.
Figure 13:
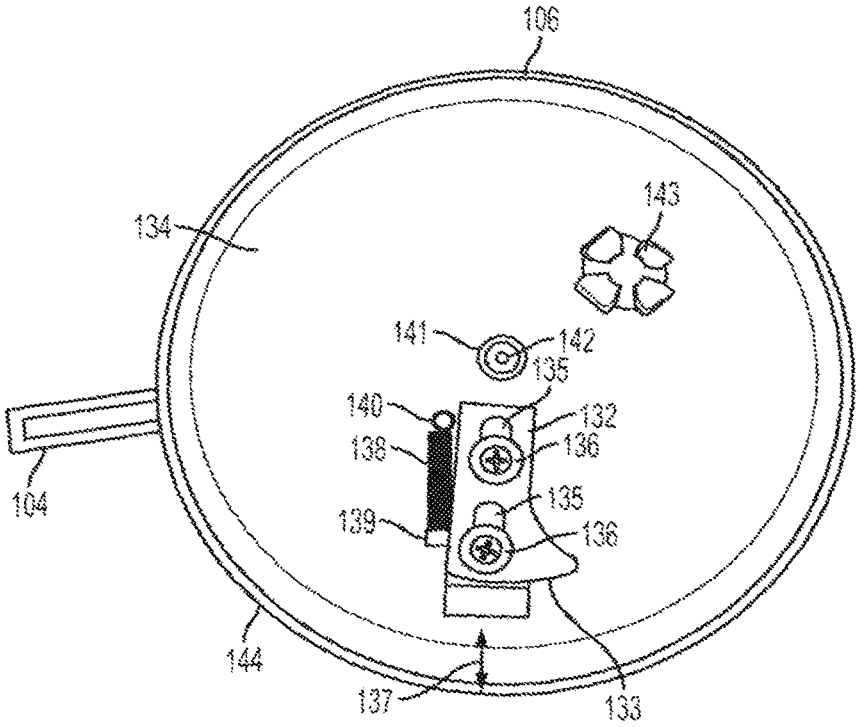
FIG. 13 is a bottom view of the rotating platform of FIG. 12.

FIG. 12 is a top perspective view, and FIG. 13 a bottom view, of rotating platform 106. As shown in FIG. 12, recess 108 has sidewalls 109*a* and 109*b* that are slightly angled inward toward one another at the back end of recess 108 so as to guide a toy vehicle 300 toward trigger 130. Trigger 130 is in the form of a paddle that may be pushed by the front of a toy vehicle 300 when it reaches the back end of recess 108, and that (as shown in the bottom view of rotating platform 106 of FIG. 13) is affixed to an actuating arm 132 that is moveably mounted to the underside 134 of rotating platform 106. Actuating arm 132 has a plurality of oblong openings 135 through which posts 136, such as threaded connectors, may be placed and joined to the underside 134 of rotating platform 106 so as to allow actuating arm 132 to move radially (in the direction of arrow 137) on the underside 134 of rotating platform 106. Actuating arm 132 preferably has a curved outer edge 133, the purpose of which will be described below.

A spring member 138 is joined to a first spring support 139 affixed to actuating arm 132, and to a second spring support 140 affixed to the underside 134 of rotating platform 106, and biases actuating arm (and thus trigger 130) towards the interior of rotating platform 106. A roller bearing 141 is positioned on a bearing hub 142 that is centrally located on underside 134 of rotating platform 106, which rotatably supports rotating platform 106 on base 120, as discussed in greater detail below.

Rotating platform 106 may be weighted, such as with one or more weights 143 positioned on the underside 134 of rotating platform 106, so as to aid in keeping rotating platform 106 balanced as it rotates on base 120. Rotating platform 106 also preferably has a downwardly extending outer rim 144 configured to fit within the upper edge of base 120.

Figure 14:
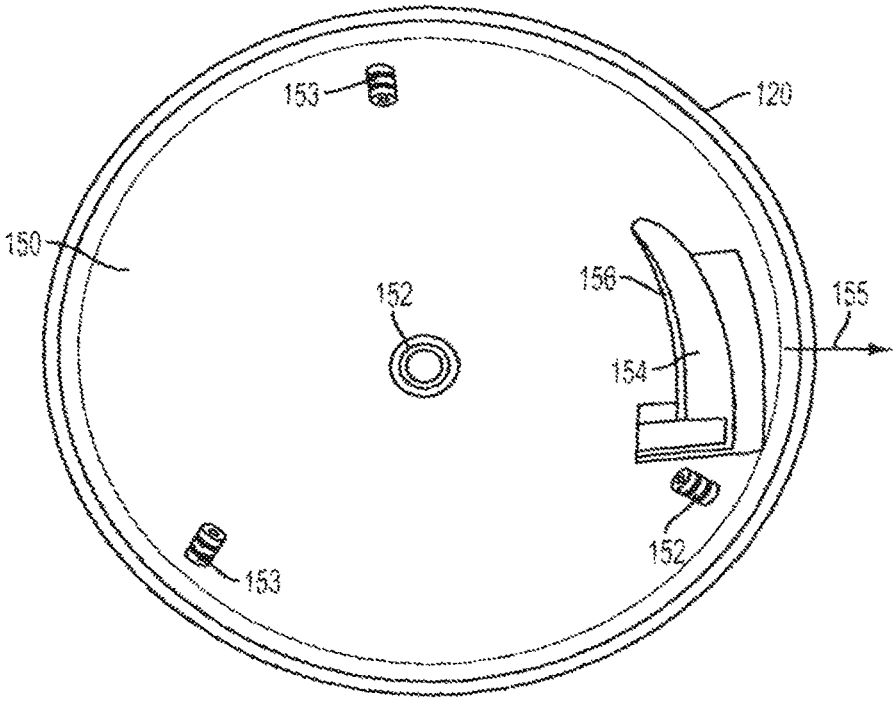
FIG. 14 is a top view of a base for supporting the rotating platform of FIG. 12.

FIG. 14 shows a top side 150 of base 120. The outer wall of base 120 forms an upwardly extending outer rim 151, sized with respect to downwardly extending outer rim 144 of rotating platform 106 so that downwardly extending outer rim 144 fits within upwardly extending outer rim 151 of base 120. A roller bearing receiver 152 is centrally located on top side 150 of base 120, and is sized to receive roller bearing 141 therein so as to rotatably mount rotating platform 106 to base 120. A plurality of guide rollers 153 may also be affixed to top side 150 of base 120, which extend upward from top side 150 to engage and support underside 134 of rotating platform 106 as it spins on base 120.

Base 120 also has a cam 154 extending upward through top side 150 of base 120, which cam is spring-biased towards the interior of base 120 and is radially moveable in the direction of arrow 155 when pushed radially outward by actuating arm 132 of rotating platform 106. Cam 154 has a curved inner face 156, which curved inner face 156 has a curve contour that is complementary to curved outer edge 133 of actuating arm 132.

Cam 154 is also mechanically connected to first, second and third retractable supports 123, 124, and 125 through a paddle bar (discussed below), such that movement of cam 154 radially outward (in the direction of arrow 155) causes such retractable supports to retract into body 120, and movement of cam 154 radially inward in the opposite direction causes such retractable supports to extend outward from body 120.

The curved length of curved outer edge 133 of actuating arm 132 on rotating platform 106 and of curved inner face 156 of cam 154 define the predetermined angular orientation of rotating platform 106 with respect to base 120 that causes the transformation of convertible track segment 100. More particularly, if curved outer edge 133 of actuating arm 132 is at least partially aligned with curved inner face 156 of cam 154 when trigger 130 is activated, movement of trigger 130 moves cam 154 radially outward, retracting the retractable supports 123, 124, and 125, and in turn dropping the toy racetrack 200 away from base 120 and rotating platform 106, and allowing outer track portion 102 to pivot downward with respect to base 120.

Figure 15:
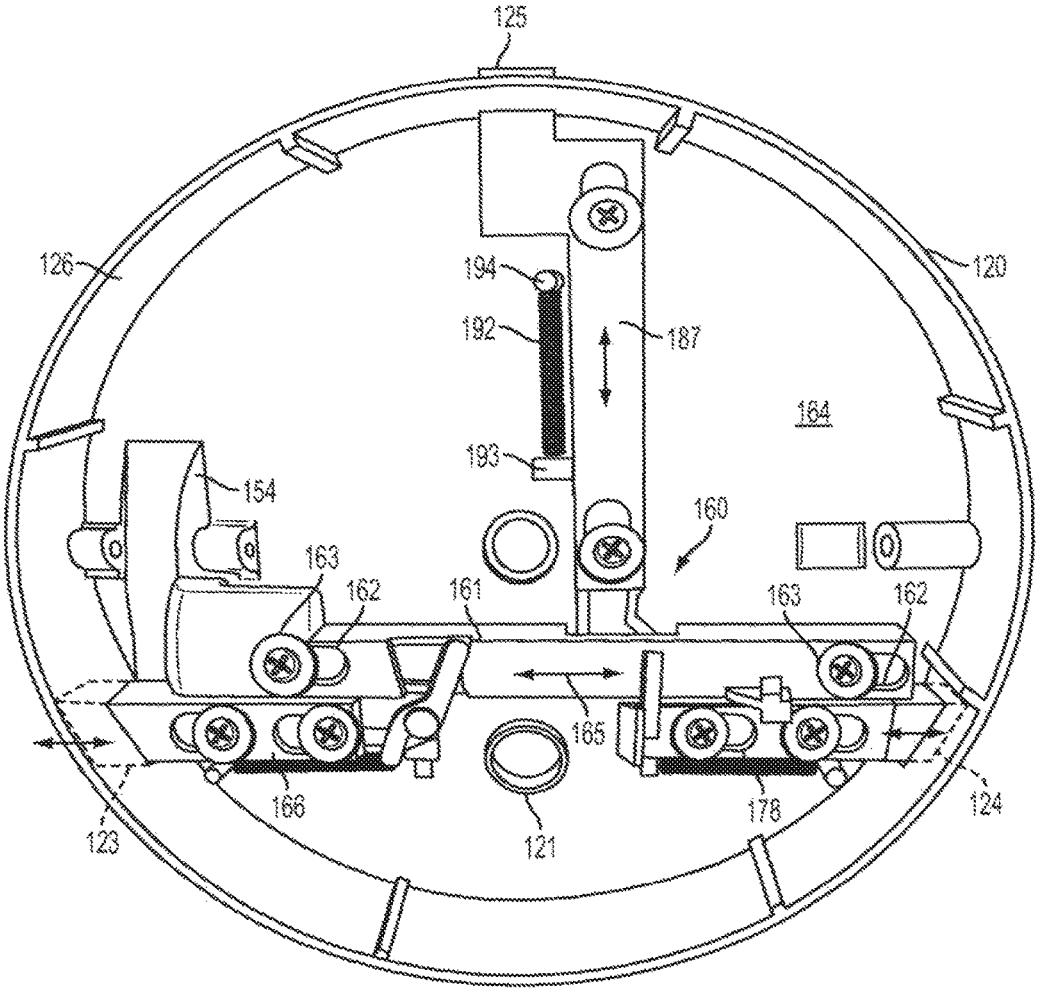
FIG. 15 is a bottom view of the base of FIG. 14.

FIG. 15 is a bottom view of base 120 and shows a paddle bar assembly (shown generally at 160) that provides a mechanical linkage between cam 154 and first, second, and third retractable supports 123, 124, and 125. Paddle bar assembly 160 includes a carrier arm 161 that is joined to cam 154. Carrier arm 161 has a plurality of oblong openings 162 through which posts 163, such as threaded connectors, are placed and joined to the underside 164 of base 120 so as to allow carrier arm 161 to move laterally (in the direction of arrow 165) on the underside 164 of base 120.

Figure 16:
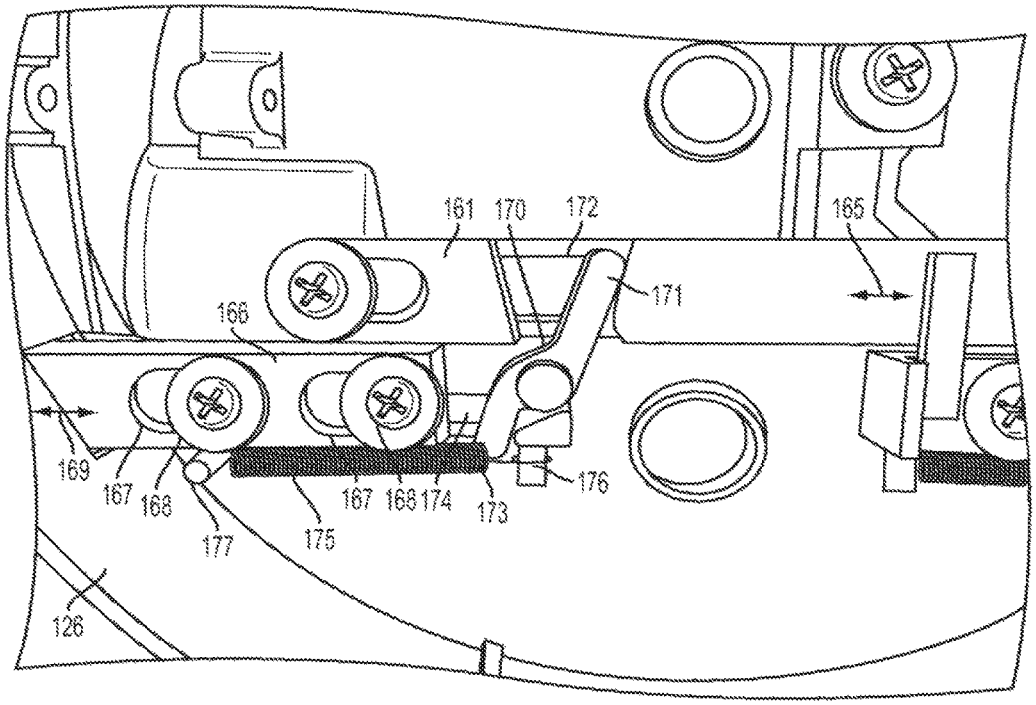
FIG. 16 is a close-up bottom view of a first portion of the base of FIG. 14.
Figure 17:
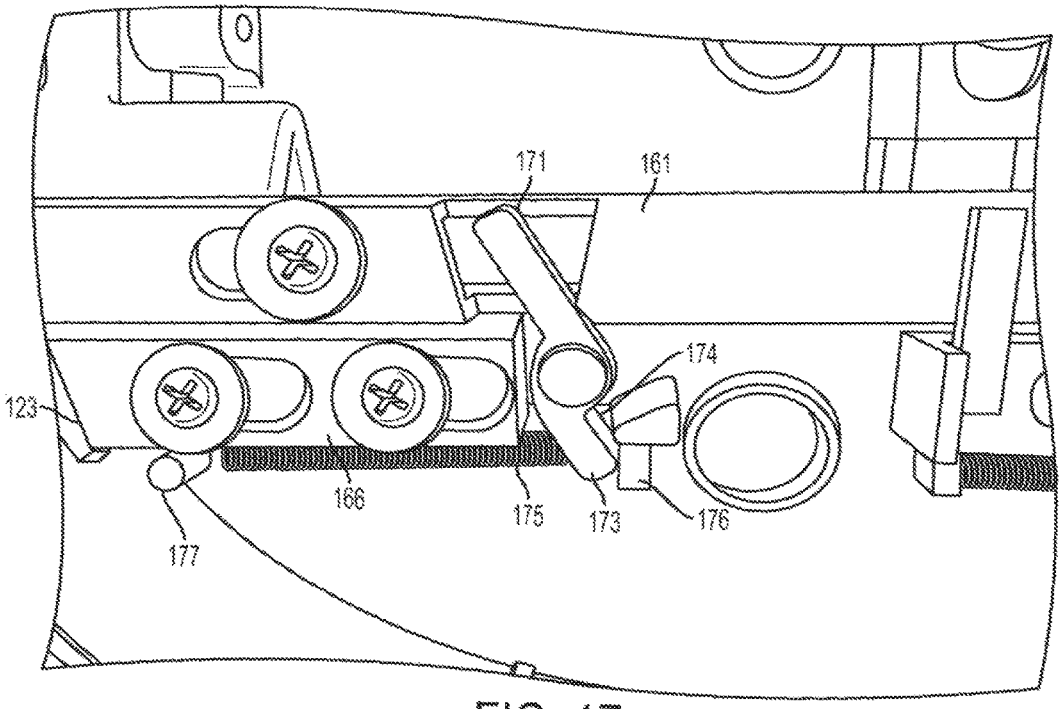
FIG. 17 is a close-up bottom view of the first portion of the base of FIG. 16 in an altered position.

A first extension arm 166 carries first retractable support 123. As shown in the close-up view of FIG. 16, first extension arm 166 has oblong openings 167 through which posts 168, such as threaded connectors, are placed and joined to the underside 164 of base 120 so as to allow first extension arm 166 to move laterally (in the direction of arrow 169) to deploy and retract first retractable support 123. A rocker arm 170 is pivotably mounted to the underside 164 of base 120, and has a first finger 171 that engages a space 172 in carrier arm 161, and a second finger 173 that engages a space 174 in first extension arm 166. With this configuration, as cam 154 is pushed radially outwardly, carrier arm 161 moves to the left in the direction of arrow 165 (as viewed in FIG. 16), moving first finger 171 to the left to pivot rocker arm 170. Pivoting of rocker arm 170 causes second finger 173 of rocker arm 170 to move to the right in the direction of arrow 169 (as viewed in FIG. 16), in turn acting against a wall of space 174 in first extension arm 166 to pull first extension arm 166 to the right, thus retracting first retractable support 123 into body 120 as shown in FIG. 17. A first extension arm spring 175 is attached at one end to a first spring carrier 176 on first extension arm 166, and at a second end to a second spring carrier 177 affixed to the underside 174 of base 120. Extension arm spring 175 biases first extension arm 166 to an extended position in which first retractable support 123 extends outward through the sidewall 126 of base 120.

Similarly, a second extension arm 178 carries second retractable support 124. As shown in the close-up view of FIG. 18, second extension arm 178 has oblong openings 179 through which posts 180, such as threaded connectors, are placed and joined to the underside 164 of base 120 so as to allow second extension arm 178 to move laterally (in the direction of arrow 181) so as to deploy and retract second retractable support 124. An engagement finger 182 is fixed to carrier arm 161, and is aligned with a reaction surface 183 on second extension arm 178. With this configuration, as cam 154 is pushed radially outwardly, carrier arm 161 moves to the left in the direction of arrow 165 (as viewed in FIG. 16), moving engagement finger 182 on carrier arm 161 to the left. This movement of engagement finger 182 causes reaction surface 183 on second extension arm 178 to pull second extension arm 178 to the left, thus retracting second retractable support 124 into body 120, as shown in FIG. 19. A second extension arm spring 184 is attached at one end to a first spring carrier 185 on second extension arm 178, and at a second end to a second spring carrier 186 affixed to the underside 164 of base 120. Second extension arm spring 184 biases second extension arm 178 to an extended position in which second retractable support 124 extends outward through the sidewall 126 of base 120.

Figure 18:
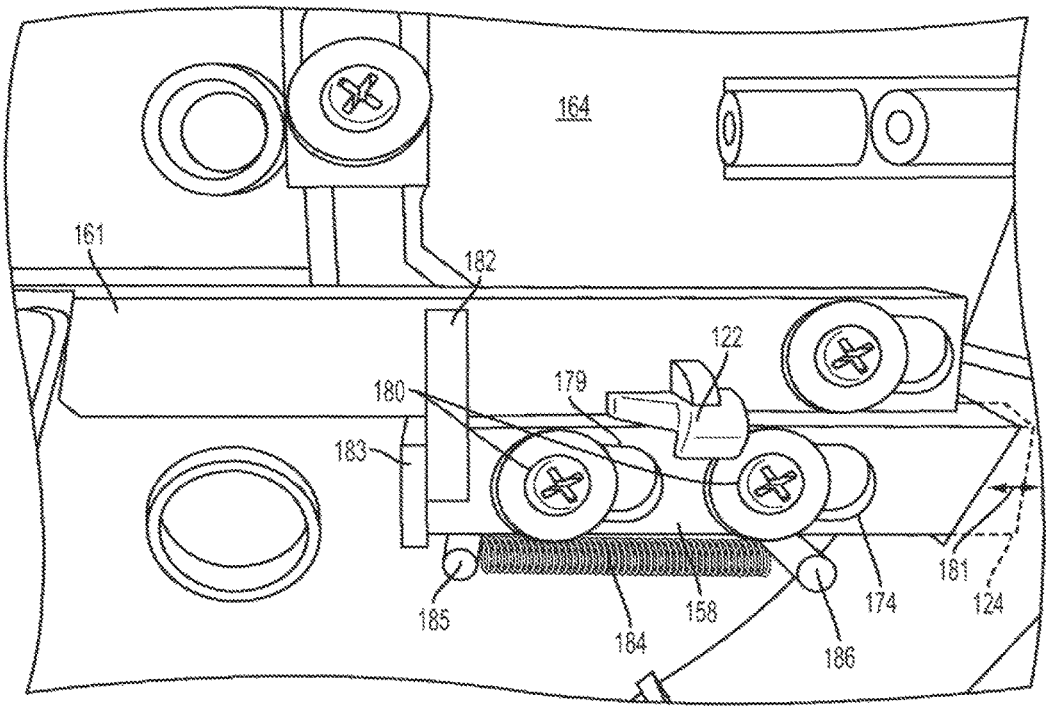
FIG. 18 is a close-up bottom view of a second portion of the base of FIG. 14.
Figure 19:
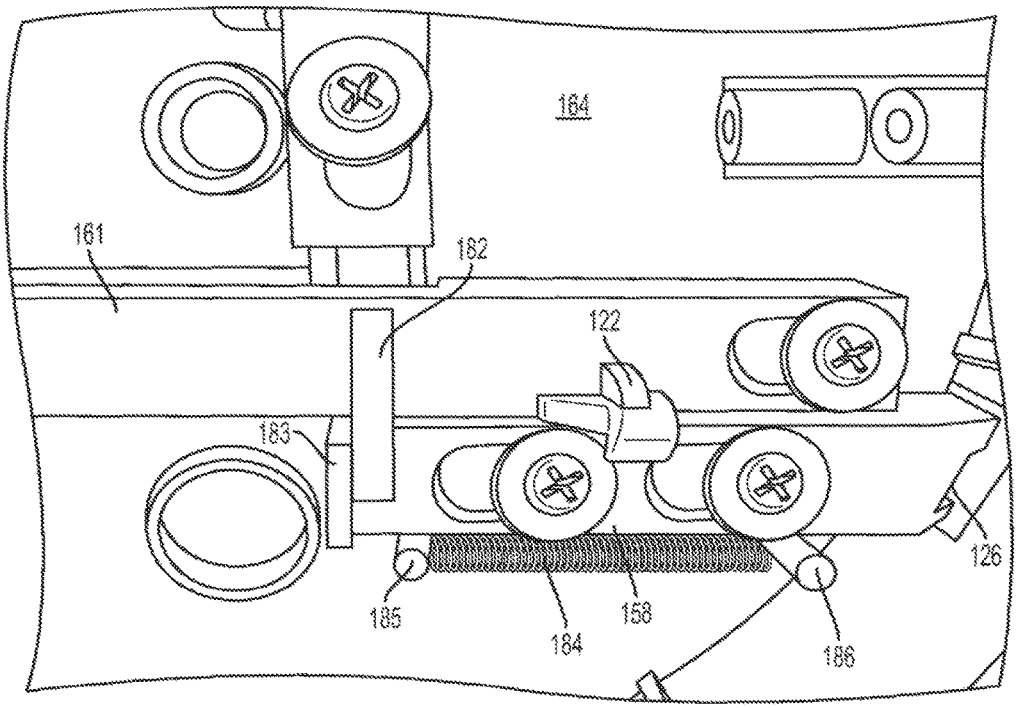
FIG. 19 is a close-up bottom view of the second portion of the base of FIG. 18.

As best shown in FIG. 18, carrier arm 161 also carries retaining hook 122, which as explained above, holds base 120 in an upwardly angled position until the trigger in recess 108 is activated (in turn ultimately moving carrier arm 161), moving retaining hook 122 away from engagement hook 117 and allowing base 110 to pivot to the horizontal position.

Figure 20:
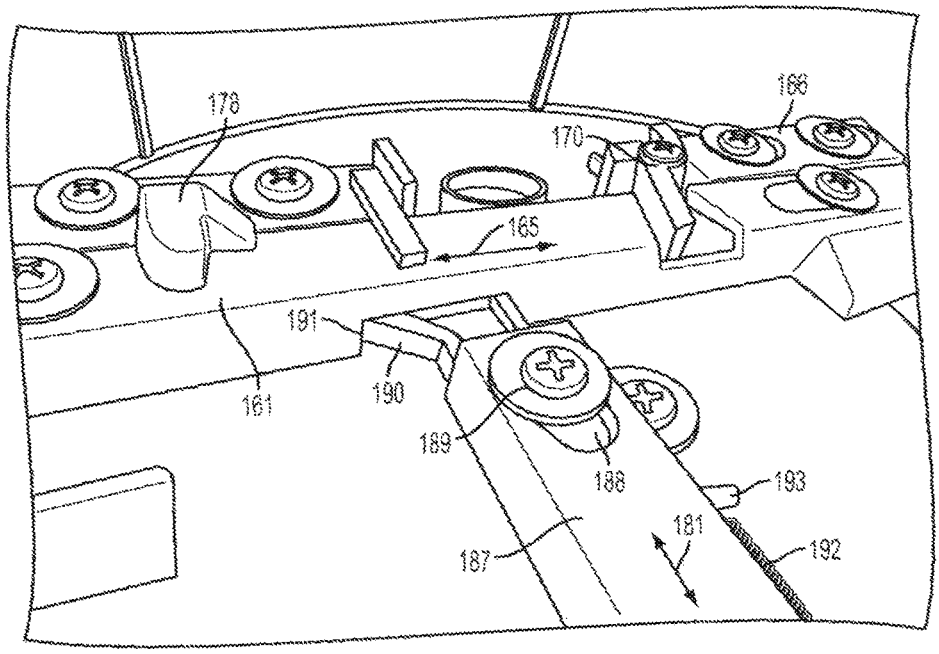
FIG. 20 is a close-up view of a third portion of the base of FIG. 14.

Still further, a third extension arm 187 carries third retractable support 125. As shown in the close-up view of FIG. 20, third extension arm 187 has oblong openings 188 through which posts 189, such as threaded connectors, are placed and joined to the underside 164 of base 120 so as to allow third extension arm 187 to move laterally (in the direction of arrow 181, which is generally perpendicular to the directions travelled by first extension arm 166 and second extension arm 178) so as to deploy and retract third retractable support 125. An interior end of third extension arm 187 has an angled cam surface 190 that engages an opening 191 along the edge of carrier arm 161. With this configuration, as cam 154 is pushed radially outwardly, carrier arm 161 moves to the right in the direction of arrow 165 (as viewed in FIG. 20), moving opening 191 on carrier arm 161 to the right. This movement of opening 191 causes the edge of opening 191 to engage angled cam surface 190 to pull third extension arm 187 toward carrier arm 161, thus retracting third retractable support 125 into body 120. A third extension arm spring 192 is attached at one end to a first spring carrier 193 on third extension arm 187, and at a second end to a second spring carrier 194 affixed to the underside 164 of base 120. Third extension arm spring 192 biases third extension arm 187 to an extended position in which third retractable support 125 extends outward through the sidewall 126 of base 120.

In use, a child launches toy vehicle 300 around track set 200, with diverter 206 positioned so as to cause toy vehicle 300 to travel through first path 202, around outer track portion 102, and back to track set 200. As toy vehicle 300 traverses outer track portion 102, it impacts arm 104 and, in turn, causes rotating platform 106 to spin. The child may continue such play until recess 108 aligns with second path 204, which coincides with platform 106 having achieved the predetermined rotational angle with respect to base 120 that allows trigger 130 to activate the transformation of convertible track segment 100. At this point, the child may move diverter 206 so as to direct toy vehicle through second path 204 and launch toy vehicle 300 so that it proceeds to recess 108 on platform 106. As toy vehicle rolls into recess 108, it strikes trigger 130, in turn causing convertible track segment 100 to transform from the track segment of FIG. 1 to the display trophy of FIG. 2, with toy vehicle 300 displayed at the top of the trophy.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A convertible track segment comprising:

a tower;

a base mounted atop the tower, the base having a retractable support; and a platform rotatably mounted atop the base and configured to spin about a vertical axis defined by the base, the platform having a trigger operable to retract the retractable support into the base.

2. The convertible track segment of claim 1, wherein the base is pivotably mounted atop the tower.

3. The convertible track segment of claim 2, wherein the trigger is operatively connected to a catch holding the base in a first position, and wherein the trigger is further operable to release the catch so as to cause the base to pivot with respect to the tower from the first position to a second position.

4. The convertible track segment of claim 3, the platform further comprising a toy vehicle recess extending from an entrance located at a peripheral edge of the platform toward an opposite side of the platform, wherein in the first position, the recess is positioned at an angle with respect to a surface on which the tower is positioned, and in the second position, the recess is parallel to the surface.

5. The convertible track segment of claim 4, wherein the trigger is positioned at an end of the recess opposite the entrance of the recess.

6. The convertible track segment of claim 5, wherein the trigger is operable to retract the retractable support only when the platform is within a predetermined rotational angle with respect to the base.

7. The convertible track segment of claim 1, further comprising a portion of a toy vehicle track set removably connectable to the base, wherein the retractable support is positioned to support the portion of the toy vehicle track set in a first position adjacent the platform, and is operable to cause the portion of the toy vehicle track set to fall with respect to the platform upon retraction of the retractable support.

8. The convertible track segment of claim 7, the platform further comprising a toy vehicle recess extending from an entrance located at a peripheral edge of the platform toward an opposite side of the platform.

9. The convertible track segment of claim 8, wherein the trigger is positioned at an end of the recess opposite the entrance of the recess.

10. The convertible track segment of claim 9, wherein the trigger is operable to retract the retractable support only when the platform is within a predetermined rotational angle with respect to the base.

11. The convertible track segment of claim 1, further comprising an outer track section surrounding at least a portion of the platform, wherein the outer track section is pivotally attached to the base.

12. The convertible track segment of claim 11, wherein the retractable support is positioned to support at least a portion of the outer track section adjacent the platform, and is operable to cause the outer track section to pivot downward with respect to the platform upon retraction of the retractable support.

13. The convertible track segment of claim 12, the platform further comprising a toy vehicle recess extending from an entrance located at a peripheral edge of the platform toward an opposite side of the platform, wherein the trigger is positioned at an end of the recess opposite the entrance of the recess.

14. The convertible track segment of claim 13, wherein the trigger is operable to retract the retractable support only when the platform is within a predetermined rotational angle with respect to the base.

15. The convertible track segment of claim 1, wherein the trigger is operable to retract the retractable support only when the platform is within a predetermined rotational angle with respect to the base.

16. The convertible track segment of claim 15, the platform further comprising a toy vehicle recess extending from an entrance located at a peripheral edge of the platform toward an opposite side of the platform.

17. The convertible track segment of claim 16, wherein the trigger is positioned at an end of the recess opposite the entrance of the recess.

18. The convertible track segment of claim 15, further comprising an outer track section surrounding at least a portion of the platform, and the platform further comprising an arm extending radially outward from the platform and into a toy vehicle path on the outer track section.

19. The convertible track segment of claim 18, wherein the arm is positioned to be impacted by a toy vehicle travelling through the outer track section to spin the platform with respect to the base.

20. A convertible track segment comprising:

a tower;

a base mounted on the tower;

a platform rotatably mounted on the base, the platform having a toy vehicle recess extending from an entrance located at a peripheral edge of the platform toward an opposite side of the platform, and a trigger positioned at an end of the recess opposite the entrance of the recess; and a retractable support within the base and engaging the trigger, wherein the trigger is operable to cause the retractable support to retract into the base only when the platform is within a predetermined angle with respect to the base.

21. The convertible track segment of claim 1, wherein a top side of the base comprises a plurality of guide rollers, the plurality of guide rollers extending upward from the top side of the base to engage an underside of the rotating platform as it spins about the vertical axis.

* * * * *